US005324207A

United States Patent [19]

Itoh et al.

[11] Patent Number: 5,324,207

[45] Date of Patent: Jun. 28, 1994

[54] CAP FOR A HIGH-TENSION CABLE TERMINAL FOR USE IN AN AUTOMOBILE ENGINE

[75] Inventors: Hiroyuki Itoh, Kameyama; Yuji Kawai, deceased, late of Hisai, Japan, by Fumio Kawai, Matsue Kawai, heirs

[73] Assignee: Sumitomo Wiring Systems, Ltd., Yokkaichi, Japan

[21] Appl. No.: 868,097

[22] Filed: Apr. 14, 1992

[30] Foreign Application Priority Data

Apr. 15, 1991 [JP] Japan ..... 3-034330[U]

[51] Int. Cl.[5] ..... H01R 13/52

[52] U.S. Cl. ..... 439/125; 439/271

[58] Field of Search ..... 439/125, 126-128, 439/271

[56] References Cited

U.S. PATENT DOCUMENTS 3,193,615 7/1965 Burrows ..... 439/127
3,842,387 10/1974 Santangelo ..... 439/271
4,492,421 1/1985 Ito ..... 439/271
4,790,767 12/1988 Sturdevan et al. ..... 439/125
4,944,259 7/1990 Richardson ..... 439/125
5,178,550 1/1993 Fusselman et al. ..... 439/125

FOREIGN PATENT DOCUMENTS 223839 3/1958 Australia ..... 439/125
2165000 4/1986 United Kingdom .

*Primary Examiner*—Gary F. Paumen
*Attorney, Agent, or Firm*—Sughrue, Mion, Zinn, Macpeak & Seas

[57] ABSTRACT

A cap is attached to a high-tension cable terminal for sealing an opening formed on an automobile engine. The cap includes a hollow cap body made of rubber and having a cylindrical portion, a hood integrally formed with and extending outwardly from the cap body, and a seal ring securely mounted on the cylindrical portion of the cap body. The seal ring is made of rubber different from the rubber of the cap body and has a high heat resistance and a sufficient elasticity. When the cap is mounted on the opening, the seal ring engages the inner peripheral surface of the opening to provide a seal against dirt, dust and water. Alternatively, the seal ring may be made of rubber of the same quality as the cap body. In this case, the hardness of the seal ring is rendered to be less than that of the cap body.

1 Claim, 4 Drawing Sheets

CAP FOR A HIGH-TENSION CABLE TERMINAL FOR USE IN AN AUTOMOBILE ENGINE

BACKGROUND OF THE INVENTION

1. Field of the Invention

The present invention relates to a cap for covering a terminal of a high-tension cable for use in an automobile engine. The cap according to the present invention is intended to seal an opening formed in a rocker cover for receiving a spark plug electrically connected to a coil tower of a distributor or an opening for receiving a plug of a direct ignition coil in an adapter.

2. Description of the Prior Art

FIG. 1 depicts a conventional rubber cap 1 (rain cover) which is attached to a high-tension cable terminal in an automobile engine. The cap 1 covers a spark plug (not shown) mounted in a plug opening 4 formed in a rocker cover of the automobile engine for connection of the spark plug with a high-tension cable. The cap 1 comprises a hollow cap body 6, a U-shaped hood 10 extending outwardly from an intermediate portion of the cap body 6, and a cylindrical sealing flap portion 11 extending downwardly from the hood 10 and having an outwardly raised portion 11*a*. Because the sealing flap portion 11 is spaced from and extends along the outer peripheral surface of the cap body 6, a cylindrical recess 12 is formed therebetween, which enables the sealing flap portion 11 to elastically deform in a direction generally perpendicular to the direction in which the sealing flap portion 11 extends. When the cap 1 is appropriately mounted on the plug opening 4, the outwardly raised portion 11*a* of the sealing flap portion 11 engages the inner peripheral surface of the plug opening 4 to provide a seal against dirt, dust and water.

In the above-described construction, however, when the engine is started and the temperature of the rocker cover increases, the sealing flap portion 11 is subjected to heat deterioration, thereby lowering the sealing performance thereof. As a result, the trouble of water entering the plug opening 4 may arise. Furthermore, when the cap 1 is inattentively mounted on the plug opening 4, an upper edge of the plug opening 4 occasionally interferes with and turns up a lower edge of the sealing flap portion 11, as shown in FIG. 2. As a result, the sealing becomes incomplete.

If a heat-resistant material superior in quality is used for the cap 1, there are no technical problems associated with the sealing performance. However, because the almost maximum cost reduction is required in manufacturing automobile parts, any solutions overcoming the technical problems are not permitted at the expense of cost. Accordingly, there has been an increasing demand for the development of a practical means overcoming the conventional problems.

SUMMARY OF THE INVENTION

The present invention has been developed to overcome the above-described disadvantages.

It is accordingly an object of the present invention to provide an improved cap having a high heat-resistance and a superior sealing performance.

Another object of the present invention is to provide a cap of the above-described type which has a simple structure and can be readily manufactured at a low cost.

In accomplishing these and other objects, a cap according to the present invention comprises a hollow cap body made of rubber, a hood integrally formed with and extending outwardly from the cap body, a flap portion integrally formed with the cap body and extending downwardly from the hood, and a seal ring housed in a recess formed on an outer peripheral surface of the flap portion. The seal ring is made of rubber different from the rubber of the cap body and has a high heat resistance. When the cap is mounted on an opening formed on an automobile engine, the seal ring engages the inner peripheral surface of the opening to provide a sealing area.

In another aspect of the present invention, a cap comprises a hollow cap body made of rubber and having a cylindrical portion, a hood integrally formed with and extending outwardly from the cap body, and a seal ring securely mounted on the cylindrical portion of the cap body. The seal ring is made of rubber different from the rubber of the cap body and has a high heat resistance and a given elasticity.

Alternatively, the seal ring may be made of rubber of the same quality as the cap body. In this case, the hardness of the seal ring is rendered to be less than the hardness of the cap body.

BRIEF DESCRIPTION OF THE DRAWINGS

These and other objects and features of the present invention will become more apparent from the following description of a preferred embodiment thereof with reference to the accompanying drawings, throughout which like parts are designated by like reference numerals, and wherein.

DETAILED DESCRIPTION OF THE PREFERRED EMBODIMENTS

Figure 1:
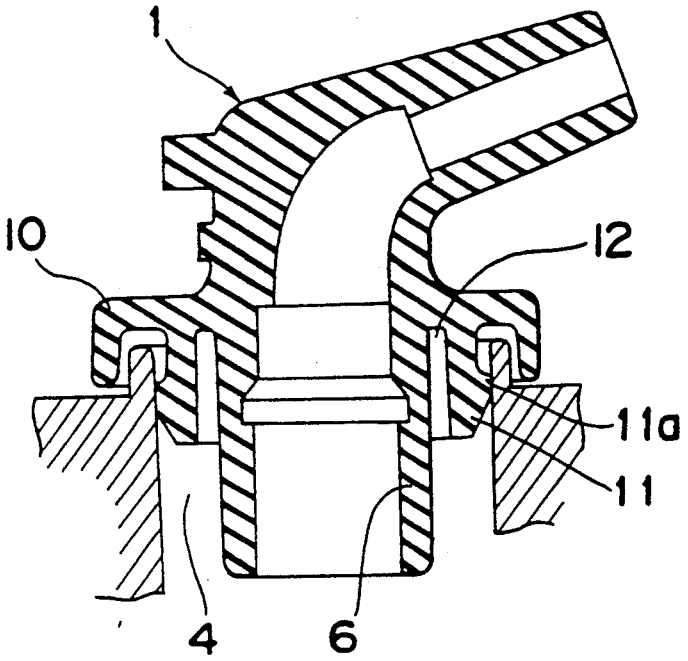
Fig.1 PRIOR ART
FIGS. 1 and 2 are cross-sectional views of a conventional cap for covering a high-tension cable terminal.
Figure 2:
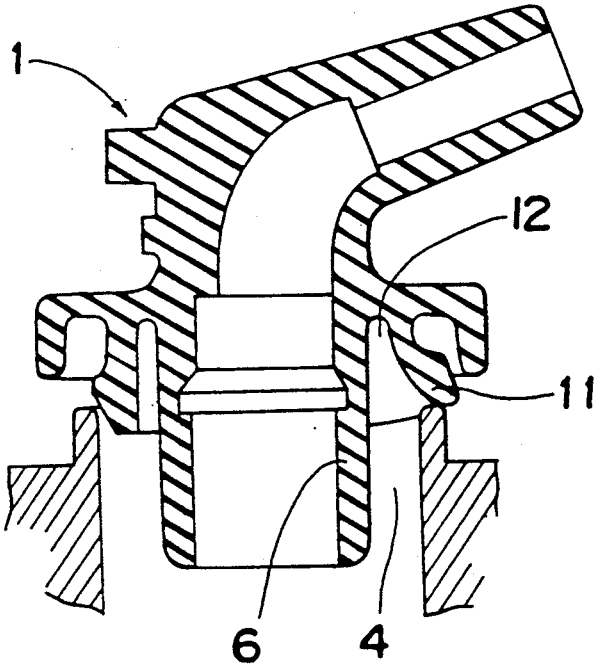
Fig.2 PRIOR ART
Figure 3:
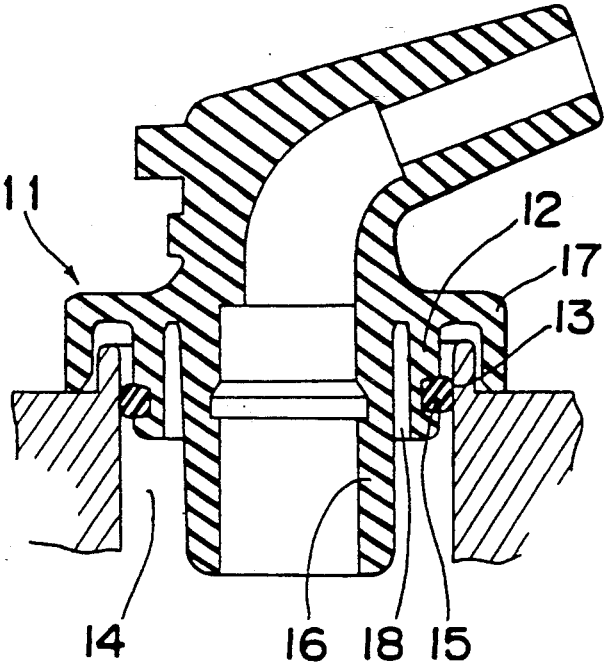
FIG. 3 is a cross-sectional view of a cap according to a first embodiment of the present invention.

Referring now to the drawings, there is shown in FIG. 3 a cap 11 according to a first embodiment of the present invention, which is attached to a high-tension cable terminal for connection of a spark plug with a high-tension cable. The cap 11 comprises a hollow cap body 16 for receiving a spark plug, a U-shaped hood 17 extending outwardly from an intermediate portion of the cap body 16, a cylindrical flap portion 12 extending downwardly from the hood 17, and a seal ring 15 housed in a recess formed on the outer peripheral surface of the flap portion 12. The flap portion 12 is spaced from and extends along the outer peripheral surface of the cap body 16. The hood 17 and the flap portion 12 are both integrally formed with the cap body 16. The cap body 16 and the seal ring 15 are made of different rubbers, respectively. The rubber of the seal ring 15 has a high heat resistance.

Because a cylindrical recess 18 is formed between the cap body 16 and the flap portion 12, the flap portion 12 is susceptible to elastic deformation in a direction perpendicular thereto. When the cap 11 is appropriately mounted on an opening 14 formed on an automobile engine, the seal ring 15 engages the inner peripheral surface of the opening 14 to provide an appropriate sealing area 13 therebetween.

Figure 4:
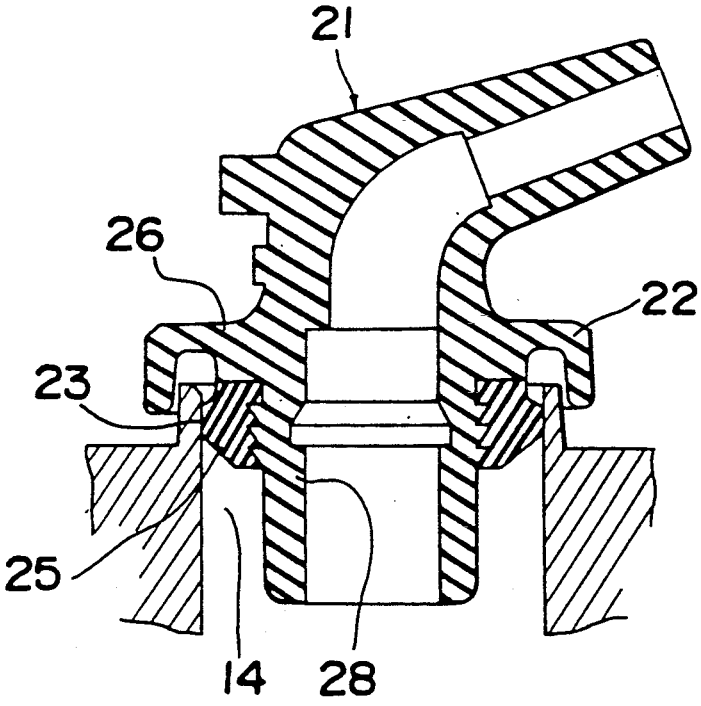
FIG. 4 is a view similar to FIG. 3, according to a second embodiment of the present invention.

FIG. 4 depicts a cap 21 according to a second embodiment of the present invention. The cap 21 also has a U-shaped hood 22 extending outwardly from an intermediate portion of a cap body 26 but has no cylindrical flap portion, unlike the cap 11 according to the first embodiment of the present invention. In this embodiment, a seal ring 25 is threaded on a cylindrical portion 28 of the cap body 26. Because the cap 21 has no elastically deformable flap portion, the seal ring 25 is made of rubber having a high heat resistance and a desired elasticity required to provide an appropriate sealing area 23 between it and the inner peripheral surface of the opening 14.

Alternatively, both the cap body 26 and the seal ring 25 may be made of rubber of the same quality. In this case, however, the rubber material is selected such that the hardness of the seal ring 25 is less than that of the cap body 26.

Silicone rubber, oil-containing silicone rubber or the like is preferably used as the material of the seal ring 15 and 25 because these rubbers have a good heat resistance and is less susceptible to heat deterioration. Alternatively, any other rubber may be used which has a low hardness and in which a large permanent compression set would not be induced.

The seal ring 15 and 25 may be placed in position on the cap body 16 and 26 by bonding, fusing, direct-molding or any other suitable engaging means.

Figure 5:
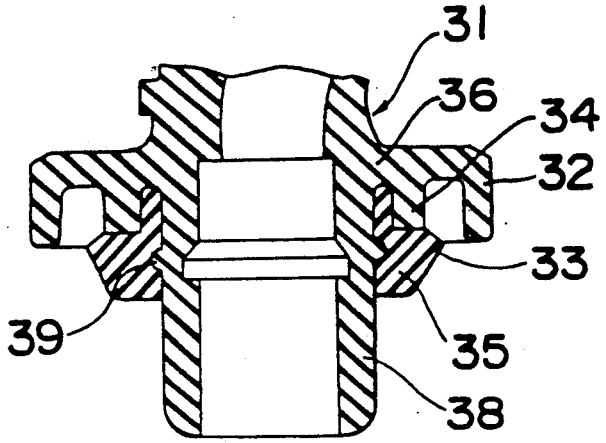
FIG. 5 is a view similar to FIG. 3, according to a third embodiment of the present invention.

FIG. 5 depicts a cap 31 according to a third embodiment of the present invention, which comprises a hollow cap body 36, a U-shaped hood 32 extending outwardly from an intermediate portion of the cap body 36, an annular rib 34 extending downwardly from the cap body 36, and a seal ring 35 mounted on a cylindrical portion 38 of the cap body 36. The hood 32 and the rib 34 are both integrally formed with the cap body 36. The cap body 36 is provided with an annular projection 39 integrally formed therewith on the cylindrical portion 38 thereof for engagement with the seal ring 35. The seal ring 35 is securely mounted on the cap body 36 by the rib 34 and the projection 39 and provides a sealing area 33 when it engages the inner peripheral surface of an opening formed on an automobile engine. The seal ring 35 is preferably made of silicone rubber or oil-containing silicone rubber whereas the cap body 36 is preferably made of relatively cheap EPDM (ethylene propylene diene terpolymer).

Alternatively, the cap body 36 and the seal ring 35 may be made of silicone rubber of the same quality. In this case, the rubber material is selected such that the hardness of the cap body 36 and that of the seal ring 35 are 55° and 40° (reference value), respectively. Because the seal ring 35 is more elastic than the cap body 36, a large permanent compression set would not be induced therein. Also, the seal ring 35 is superior in heat resistance. Accordingly, the cap has a stable sealing performance.

Figure 6:
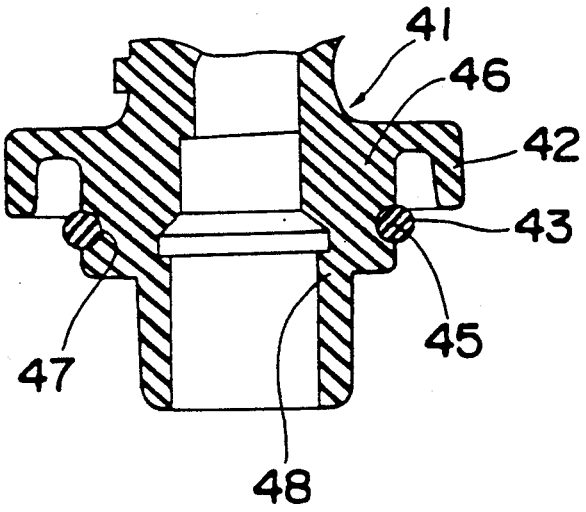
FIG. 6 is a view similar to FIG. 3, according to a fourth embodiment of the present invention.

FIG. 6 depicts a cap 41 according to a fourth embodiment of the present invention, which comprises a hollow cap body 46, a U-shaped hood 42 extending outwardly from an intermediate portion of the cap body 46, and a seal ring 45 housed in a recess 47 formed on the outer peripheral surface of a cylindrical portion 48 of the cap body 46. The seal ring 45 is an O-ring made of oil-containing silicone rubber whereas the cap body 46 is made of EPDM. When the seal ring 45 engages the inner peripheral surface of an opening formed on an automobile engine, a sealing area 43 is formed therebetween.

Because the caps as shown in FIGS. 4 to 6 have no flap portions spaced from the cylindrical portion of the cap body, each of them can be readily mounted on an opening formed on an automobile engine.

Figure 7:
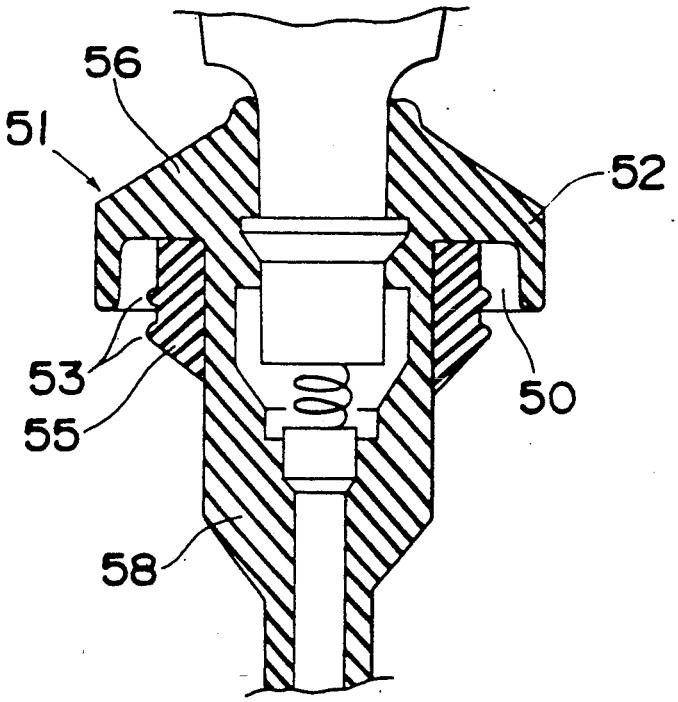
FIG. 7 is a view similar to FIG. 3, according to a fifth embodiment of the present invention.

FIG. 7 depicts a cap 51 according to a fifth embodiment of the present invention, which is attached to one end of a coil and is covered on an opening for receiving a plug of a direct ignition coil in an adapter for connection of the coil with the plug. The cap 51 comprises a hollow cap body 56, a cup-shaped hood 52 extending outwardly from an upper portion of the cap body 56, and a seal ring 55 securely mounted on a cylindrical portion 58 of the cap body 56 and housed in a recess 50 formed between the cylindrical portion 58 and the hood 52. The seal ring 55 is provided with two spaced annular projections 53 to provide respective sealing areas. The seal ring 55 is made of silicone rubber or oil-containing silicone rubber whereas the cap body 56 is made of EPDM.

As is clear from the above, the cap according to the present invention has a superior sealing performance and the material of the cap except the seal ring can be appropriately selected from a variety of rubbers. Furthermore, the caps as shown in FIGS. 4 to 7 have no flap portions, and therefore, each of them can be readily mounted on an opening formed on an automobile engine.

Although the present invention has been fully described by way of examples with reference to the accompanying drawings, it is to be noted here that various changes and modifications will be apparent to those skilled in the art. Therefore, unless such changes and modifications otherwise depart from the spirit and scope of the present invention, they should be construed as being included therein.

What is claimed is:

1. A cap attached to a high-tension cable terminal for sealing an opening formed on an automobile engine, said cap comprising:

a hollow cap body made of rubber;

a hood integrally formed with and extending outwardly from said cap body;

a flap portion integrally formed with said cap body and extending downwardly from said hood; and a seal ring housed in a recess formed on an outer peripheral surface of said flap portion, said seal ring being made of rubber different from the rubber of said cap body and having a high heat resistance relative to a heat resistance of the rubber of said cap body, whereby, when said cap is mounted on the opening, said seal ring engages an inner peripheral surface of the opening to provide a sealing area.

* * * * *